US007961149B2

(12) United States Patent
Tsai

(10) Patent No.: US 7,961,149 B2
(45) **Date of Patent: *Jun. 14, 2011**

(54) ANTENNA STRUCTURE

(75) Inventor: Hsiao-Ming Tsai, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/834,812

(22) Filed: Jul. 12, 2010

(65) Prior Publication Data

US 2010/0277391 A1 Nov. 4, 2010

Related U.S. Application Data

(63) Continuation of application No. 12/183,014, filed on Jul. 30, 2008, now Pat. No. 7,773,036.

(30) Foreign Application Priority Data

Aug. 24, 2007 (TW) ..... 96131466 A

(51) Int. Cl.
*H01Q 1/38* (2006.01)
*H01Q 1/24* (2006.01)
*H01Q 1/48* (2006.01)

(52) U.S. Cl. ..... 343/700 MS; 343/702; 343/846

(58) Field of Classification Search ..... 343/700 MS, 343/702, 846, 850, 873
See application file for complete search history.

(56) References Cited

U.S. PATENT DOCUMENTS

| | | | | |
|---|---|---|---|---|
| 6,853,335 | B1 * | 2/2005 | Yeh | 343/700 MS |
| 6,956,530 | B2 * | 10/2005 | Kadambi et al. | 343/702 |
| 7,259,720 | B2 * | 8/2007 | Ryu | 343/700 MS |
| 7,541,980 | B2 * | 6/2009 | Shih | 343/700 MS |

* cited by examiner

*Primary Examiner* — Shih-Chao Chen

(57) ABSTRACT

An antenna structure includes a circuit board with a ground surface and a printed antenna. The printed antenna includes a signal feed-in portion, a first radiating unit connected to the signal feed-in portion and a second radiating unit connected to the first radiating unit. The first radiating unit includes a first printed thickness, and the second radiating unit includes a second printed thickness. At least part of the second printed thickness is larger than the first printed thickness.

16 Claims, 3 Drawing Sheets

ANTENNA STRUCTURE

CROSS REFERENCE TO RELATED APPLICATIONS

This application is a Continuation of pending U.S. patent application Ser. No. 12/183,014, filed on Jul. 30, 2008, which claims priority of Taiwan Patent Application No. 096131466, filed on Aug. 24, 2007, the entirety of which are incorporated by reference herein.

BACKGROUND OF THE INVENTION

1. Field of the Invention

The invention relates to an antenna structure and, more particularly, to an antenna structure which is directly printed on a circuit board.

2. Description of the Related Art

Because of the demand of the market, the sizes of electronic devices such as notebook computers or mobile phones become smaller and smaller. If the sizes of antennas in the electronic devices also decrease correspondingly, it helps the electronic devices to be small.

If an antenna used in a 2.4 GHz band is designed as one-quarter of the wavelength, the volume of the antenna is about 720 $mm^3$. As a result, the antenna is difficult to be applied to a small electronic device. An antenna also can be made of multilayer ceramic material, and then the antenna can have a small size via the high dielectric coefficient of the ceramic material. However, the cost of the antennas made of the ceramic material is high, and the radiation efficiency is low (about fifty percent). If the antenna made of the multilayer ceramic material is disposed in a little casing, the working bandwidth decreases, and then the communication quality of part of the band decreases.

BRIEF SUMMARY OF THE INVENTION

The invention provides an antenna structure including a circuit board and a printed antenna. The circuit board has a ground surface. The printed antenna is arranged on the circuit board, and the printed antenna includes a signal feed-in portion, a first radiating unit and a second radiating unit. The first radiating unit is connected to the signal feed-in portion, and the first radiating unit has a first end and a second end. The first radiating unit diverges and forms a first radiating element and a second radiating element at the first end. The first radiating element and the second radiating element are combined at the second end, and the first radiating element has a first turning portion. The second radiating unit is connected to the first radiating unit. The second radiating unit includes a third radiating element, a fourth radiating element, a second turning portion and a third turning portion. The second turning portion is located between the third radiating element and the second end. The third turning portion is located between the third radiating element and the fourth radiating element, and a distance is formed between the fourth radiating element and the ground surface. The first radiating unit includes a first printed thickness, and the second radiating unit includes a second printed thickness. At least part of the second printed thickness is larger than the first printed thickness.

The antenna structure of the invention has a tiny volume, and the printed antenna can be directly printed on the circuit board. Compared with a conventional multilayer ceramic antenna, the cost of the antenna structure of the invention is low, and the working bandwidth and the radiation efficiency of the antenna structure of the invention greatly increase.

These and other features, aspects, and advantages of the present invention will become better understood with regard to the following description, appended claims, and accompanying drawings.

DETAILED DESCRIPTION OF THE EMBODIMENTS

Figure 1:
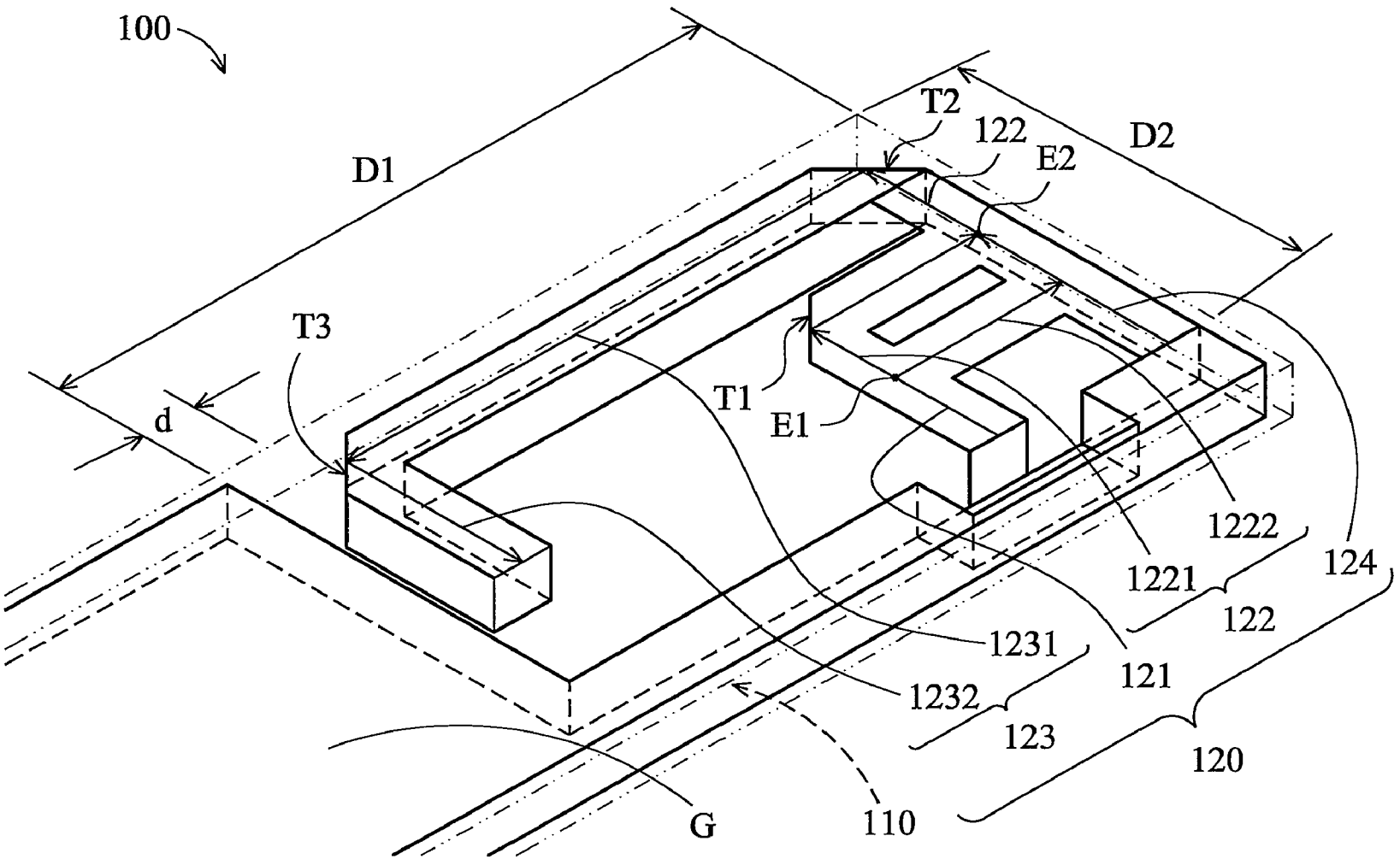
FIG. 1 is a schematic diagram showing an antenna structure of one embodiment of the invention.

As shown in FIG. 1, an antenna structure 100 of one embodiment of the invention is a circuit board antenna, and it can be applied to any electronic device and a 2.4 GHz wireless local area network (WLAN), a Bluetooth system or a radio frequency identification (RFID) system.

The antenna structure 100 includes a substrate, such as a circuit board 110 and a printed antenna 120 printed on the circuit board 110. In the embodiment, the thickness of the circuit board 110 is 0.81 mm, and the circuit board 110 has a ground surface G.

Figure 3:
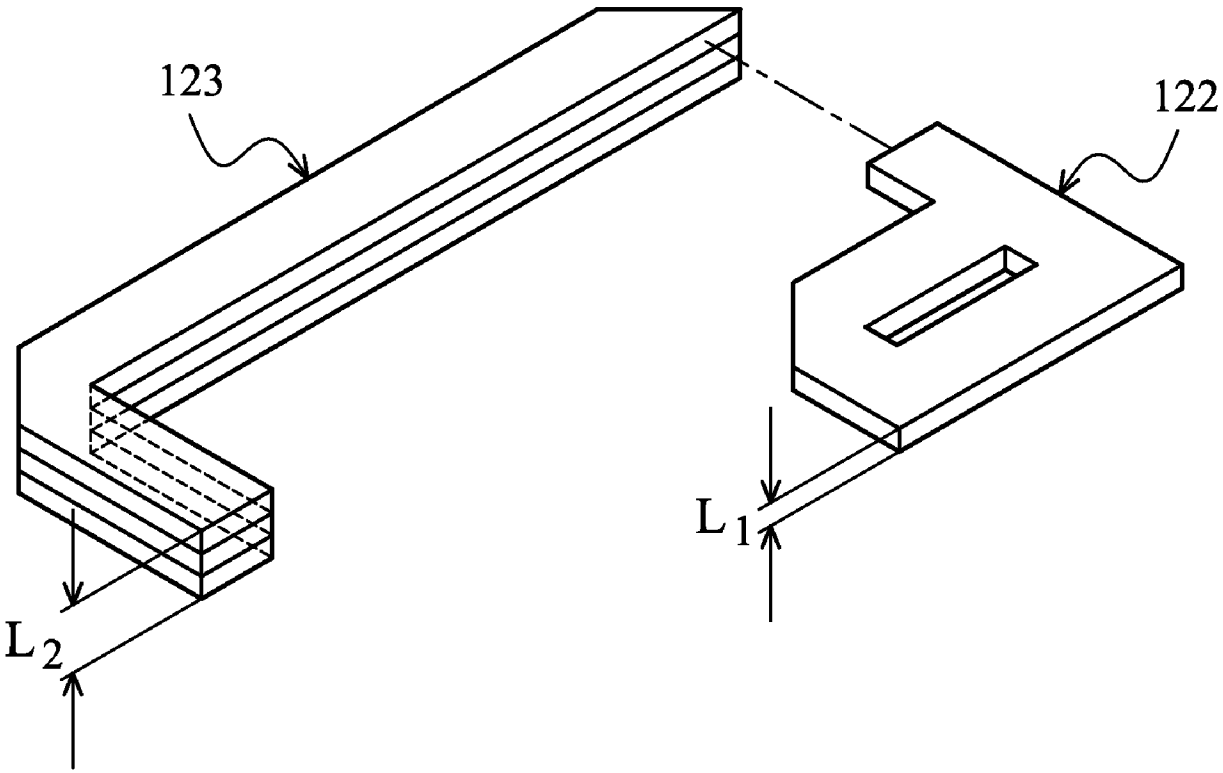
FIG. 3 is an exploded view of the first radiating unit and the second radiating unit of the one embodiment of the invention.

The printed antenna 120 includes a signal feed-in portion 121, a first radiating unit 122, a second radiating unit 123 and a ground portion 124. The signal feed-in portion 121, the first radiating unit 122, the second radiating unit 123 and the ground portion 124 are printed on the circuit board 110. As shown in FIG. 3, the first radiating unit 122 includes a first printed thickness $L_1$, and the second radiating unit 123 includes a second printed thickness $L_2$. At least part of the second printed thickness $L_2$ is larger than the first printed thickness $L_1$. The signal feed-in portion 121 is used for receiving or transmitting a signal received or transmitted by the first radiating unit 122 and the second radiating unit 123. The transmission path of the signal is denoted by arrows shown in FIG. 1 (only one direction of the signal transmission path is shown in FIG. 1, but the embodiment is not limited by this.).

The signal feed-in portion 121 has a first end E1. The first radiating unit 122 diverges and forms a first radiating element 1221 and a second radiating element 1222 at the first end E1. The first radiating element 1221 and the second radiating element 1222 are combined at a second end E2. The first radiating element 1221 has a first turning portion T1, the second radiating element 1222 is connected to the ground portion 124. Then the printed antenna can be connected to the ground surface G via the ground portion 124 to be connected to ground.

The second radiating unit 123 includes a third radiating element 1231, a fourth radiating element 1232, a second turning portion T2 and a third turning portion T3. The second radiating unit 123 is connected to the first radiating unit 122 via the third radiating element 1231. The second turning portion T2 is located between the third radiating element 1231 and the first radiating unit 122, and the third turning portion T3 is located between the third radiating element 1231 and the fourth radiating element 1232. A distance d is formed between the fourth radiating element 1232 and the ground surface G to generate a parasitic capacitance.

The signal is sent by the signal feed-in portion 121. When the signal is transmitted through the first radiating unit 122, the signal can be selectively transmitted through the first radiating element 1221 and the first turning portion T1 or through the second radiating element 1222 to enter the second radiating unit 123. Then, the signal enters the third radiating element 1231 through the second turning portion T2 and further enters the fourth radiating element 1232 through the third turning portion T3. The first turning portion T1, the second turning portion T2 and the third turning portion T3 have forty-five degree angles with the incident direction of the signal, and then the signal can be rapidly transmitted.

The printed antenna 120 of the embodiment of the invention occupies an area of the circuit board, and the size of the area is about 71.96 $mm^2$. The ratio of the length D1 of the area to the width D2 of the area is about 1.7:1. Ratios of the distance d between the fourth radiating element 1232 and the ground surface G to the length D1 and the width D2 of the area are about 1:14 and about 1:8, respectively.

In another embodiment of the invention, the printed antenna 120 includes a signal feed-in portion 121, a first radiating unit 122, a second radiating unit 123 and a ground portion 124. The signal feed-in portion 121, the first radiating unit 122, the second radiating unit 123 and the ground portion 124 is printed on the circuit board 110. As shown in FIG. 3, the first radiating unit 122 includes a first number of printed layers, and the second radiating unit 123 includes a second number of printed layers. The second number of printed layers is larger than the first number of printed layers. In this embodiment, the first number of printed layers is one and the second number of printed layers is three; however, it should not be considered limiting.

Figure 2:
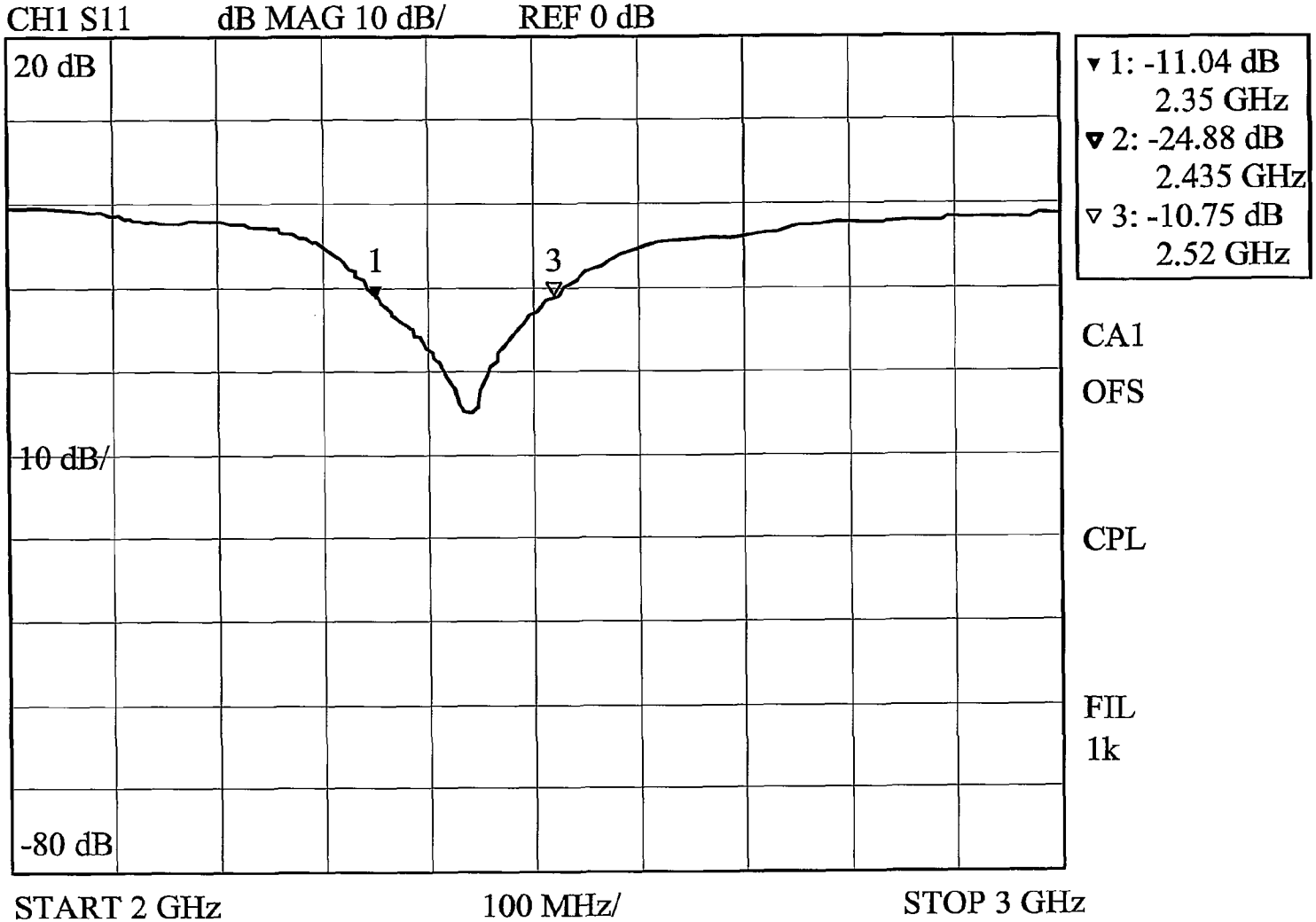
FIG. 2 is a schematic diagram showing the measured working bandwidth of an antenna structure of one embodiment of the invention.

As shown in FIG. 2, FIG. 2 is a schematic diagram showing measured S11 data of an antenna according to a preferred embodiment of the invention. The usable bandwidth of antennas are generally required to satisfy S11<−10 dB (or voltage standing wave ratio (VSWR)<1.92; the two parameters have the same meaning and can be derived from each other). In FIG. 2, S11 is −11.04 dB and the frequency is 2.35 GHz at point 1 (▼), and S11 is −10.75 dB and the frequency is 2.52 GHz at point 3( ). A bandwidth between the frequency 2.35 GHz and the frequency 2.52 GHz is 0.17 GHz, and S11 is less than −10 dB, so that the bandwidth is a usable bandwidth which is 170 MHz. The printed antenna 120 of the embodiment of the invention occupies a small area, but its radiation efficiency is above seventy percent, and the usable bandwidth reaches 170 MHz.

From the above, the antenna structure 100 of the preferred embodiment of the invention has a tiny volume, and the printed antenna 120 can be directly printed on the circuit board 110. Compared with a conventional multilayer ceramic antenna, the cost of the antenna structure of the invention is low, and the working bandwidth and the radiation efficiency of the antenna structure of the invention are greatly increased.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

The invention claimed is:

1. An antenna structure comprising:

a substrate; and a printed antenna arranged on the substrate comprising:

a signal feed-in portion;

a first radiating unit connected to the signal feed-in portion, having a first printed thickness; and a second radiating unit connected to the first radiating unit, having a second printed thickness;

wherein, at least a part of the second printed thickness is larger than the first printed thickness;

wherein the first radiating unit comprises a first end and a second end, wherein the first radiating unit diverges and forms a first radiating element and a second radiating element at the first end, and the first radiating element and the second radiating element are combined at the second end; and wherein the first radiating unit comprises a first turning portion and the second radiating unit comprises a third radiating element, a fourth radiating element, a second turning portion and a third turning portion, wherein the second turning portion is located between the third radiating element and the second end, and the third turning portion is located between the third radiating element and the fourth radiating element.

2. The antenna structure according to claim 1, wherein the substrate comprises a ground surface.

3. The antenna structure according to claim 2, wherein a distance is formed between the second radiating unit and the ground surface.

4. The antenna structure according to claim 1, wherein the substrate is a circuit board.

5. The antenna structure according to claim 1, wherein the printed antenna occupies an area of the substrate, and the ratio of the length of the area to the width of the area is about 1.7:1.

6. The antenna structure according to claim 5, wherein the ratio of the distance to one length of the area is about 1:14.

7. The antenna structure according to claim 5, wherein the ratio of the distance to one width of the area is about 1:8.

8. The antenna structure according to claim 1, wherein the printed antenna further comprises a ground portion connected to the first radiating unit.

9. The antenna structure according to claim 1, wherein the printed antenna further comprises a ground portion connected to the second radiating unit.

10. The antenna structure according to claim 1, wherein the signal feed-in portion receives or transmits a signal, and the first turning portion, the second turning portion and the third turning portion have forty-five degree angles with the incidence direction of the signal.

11. The antenna structure according to claim 1, wherein the signal enters from the feed-in portion and is selectively transmitted through the first radiating element or the second radiating element of the first radiating unit to enter the second radiating unit.

12. An antenna structure comprising:

a substrate; and a printed antenna arranged on the substrate comprising:

a signal feed-in portion;

a first radiating unit connected to the signal feed-in portion, having a first number of printed layers; and a second radiating unit connected to the first radiating unit, having a second number of printed layers;

wherein, the second number of printed layers is larger than the first number of printed layers;

wherein the first radiating unit comprises a first end and a second end, wherein the first radiating unit diverges and forms a first radiating element and a second radiating element at the first end, and the first radiating element and the second radiating element are combined at the second end; and wherein the first radiating unit comprises a first turning portion and the second radiating unit comprises a third radiating element, a fourth radiating element, a second turning portion and a third turning portion, wherein the second turning portion is located between the third radiating element and the second end, and the third turning portion is located between the third radiating element and the fourth radiating element.

13. The antenna structure according to claim 12, wherein the substrate comprises a ground surface.

14. The antenna structure according to claim 13, wherein a distance is formed between the second radiating unit and the ground surface.

15. An antenna structure comprising:

a substrate; and a printed antenna arranged on the substrate comprising:

a signal feed-in portion;

a first radiating unit connected to the signal feed-in portion, having a first printed thickness, and diverging a first radiating element and a second radiating element, the first radiating element and the second radiating element are combined at an end; and a second radiating unit connected to the end of the first radiating unit, having a second printed thickness;

wherein, the second printed thickness is larger than the first printed thickness;

wherein the first radiating unit comprises a first end and a second end, wherein the first radiating unit diverges and forms a first radiating element and a second radiating element at the first end, and the first radiating element and the second radiating element are combined at the second end; and wherein the first radiating unit comprises a first turning portion and the second radiating unit comprises a third radiating element, a fourth radiating element, a second turning portion and a third turning portion, wherein the second turning portion is located between the third radiating element and the second end, and the third turning portion is located between the third radiating element and the fourth radiating element.

16. The antenna structure according to claim 15, wherein the substrate comprises a ground surface, and a distance is formed between the second radiating unit and the ground surface.

* * * * *